US006921006B2

(12) United States Patent
Bauer

(10) Patent No.: US 6,921,006 B2
(45) Date of Patent: Jul. 26, 2005

(54) QUICK-CHANGE WATCHBANDS

(76) Inventor: Tonya Daree Bauer, 15210 Steinbeck La., Colorado Springs, CO (US) 80921

( * ) Notice: Subject to any disclaimer, the term of this patent is extended or adjusted under 35 U.S.C. 154(b) by 182 days.

(21) Appl. No.: 10/008,986

(22) Filed: Nov. 2, 2001

(65) Prior Publication Data

US 2002/0070252 A1 Jun. 13, 2002

Related U.S. Application Data

(60) Provisional application No. 60/256,615, filed on Dec. 19, 2000, provisional application No. 60/254,993, filed on Dec. 12, 2000, and provisional application No. 60/254,988, filed on Dec. 12, 2000.

(51) Int. Cl.[7] ..... A44C 5/00

(52) U.S. Cl. ..... 224/164; 224/177; 224/219; 224/901.4; 24/265 WS; 368/282

(58) Field of Search ..... 224/164, 166–167, 224/177, 180, 219, 665, 675, 901.4; 24/265 WS; 368/282

(56) References Cited

U.S. PATENT DOCUMENTS 1,702,855 A * 2/1929 Swanson ..... 24/265 WS
2,359,148 A * 9/1944 Partridge ..... 224/164
2,499,898 A * 3/1950 Anderson ..... 24/442
3,848,270 A * 11/1974 Rand ..... 2/311
4,103,808 A * 8/1978 Hallman et al. ..... 224/168
D287,229 S * 12/1986 Hallman et al. ..... D11/5
5,035,000 A * 7/1991 Matthias ..... 2/123
5,332,135 A * 7/1994 Fletcher ..... 224/164
5,425,007 A * 6/1995 Walter et al. ..... 368/282
5,762,241 A * 6/1998 Cross ..... 224/173
5,769,290 A * 6/1998 Pestana ..... 224/178
5,812,500 A * 9/1998 Webb, Jr. ..... 368/282
6,098,497 A * 8/2000 Larose ..... 81/3.4
6,108,876 A * 8/2000 Hubbert ..... 24/265 WS
6,276,580 B1 * 8/2001 Kitahara et al. ..... 224/178
6,449,815 B1 * 9/2002 Spiller ..... 24/306

* cited by examiner

*Primary Examiner*—Nathan J. Newhouse
(74) *Attorney, Agent, or Firm*—William E. Hein

(57) ABSTRACT

One-piece and two-piece watchbands may be quickly and easily installed on a watch of the wearer's choice and may just as easily be removed and replaced with another watchband to provide color and style coordination with other items of the wearer's chosen wardrobe.

2 Claims, 3 Drawing Sheets

QUICK-CHANGE WATCHBANDS

REFERENCE TO RELATED APPLICATIONS

This application incorporates the subject matter and claims the benefit of U.S. Provisional Patent Application Ser. Nos. 60/254,988 and 60/254,993, both filed on Dec. 12, 2000, and 60/256,615, filed on Dec. 19, 2000.

BACKGROUND AND SUMMARY OF THE INVENTION

This invention relates generally to watchbands and, more particularly, to a watchband that may be easily installed or removed from a watch case.

Prior art watchbands are difficult to replace in that doing so typically requires removal and reinstallation of a watchcasing pin on each side of a watchcasing. This technique is cumbersome for those who wish to utilize the various designer watchbands that are available today in order to coordinate them with other wardrobe items and may, therefore, need to change watchbands on at least a daily basis. In addition, many prior art watchbands are limited to attachment to certain watches.

It would be advantageous to provide watchbands, in accordance with various embodiments of the present invention, that may be quickly and easily installed on a watch of the wearer's choice and that may just as easily be removed and replaced with another watchband to provide color and style coordination with other items of the wearer's chosen wardrobe.

DETAILED DESCRIPTION OF THE INVENTION

Figure 1:
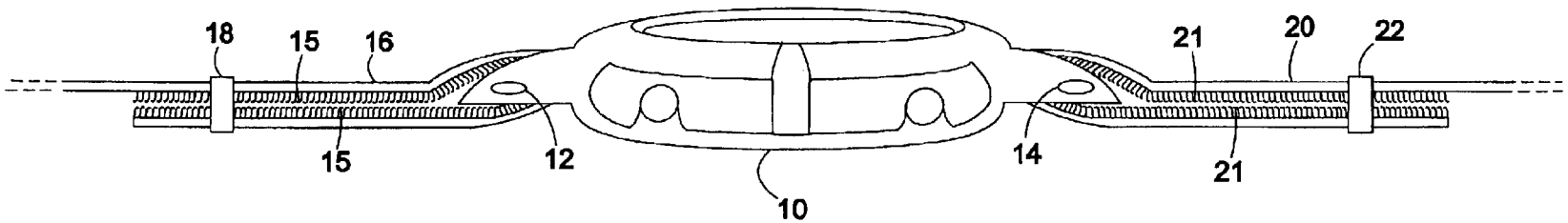
FIG. 1 is an exaggerated pictorial diagram of a watchcasing and a two-piece watchband attached thereto with a combination of velcro fasteners and security devices, in accordance with a first embodiment of the present invention.

Referring now to FIG. 1, there is shown a watchcasing 10 having conventional watchcasing pins 12, 14 at either end thereof. One piece 16 of a two-piece watchband is threaded through watchcasing 10 behind watchcasing pin 12. A hook and loop fastener surface 15 is provided on the underside of the end of watchband piece 16 that is threaded around watchcasing pin 12 to adjust the length thereof. An optional security device 18 that is adapted to slide over watchband piece 16 may be provided to retain it in the position to which it was set by the hook and loop fastener material 15. A second piece 20 of the two-piece watchband is similarly threaded through watchcasing 10 behind watchcasing pin 14, adjusted to a desired length by means of a hook and loop fastener surface 21, and secured in the position to which it was adjusted by means of an optional second slideable security device 22. The free ends of the two pieces 16, 20 of the two-piece watchband may be terminated in any of a number of conventional fasteners, not illustrated, such as buckles, snaps, clasps, etc., to secure the watchband and watchcasing 10 attached thereto to the wearer's wrist.

Figure 2:
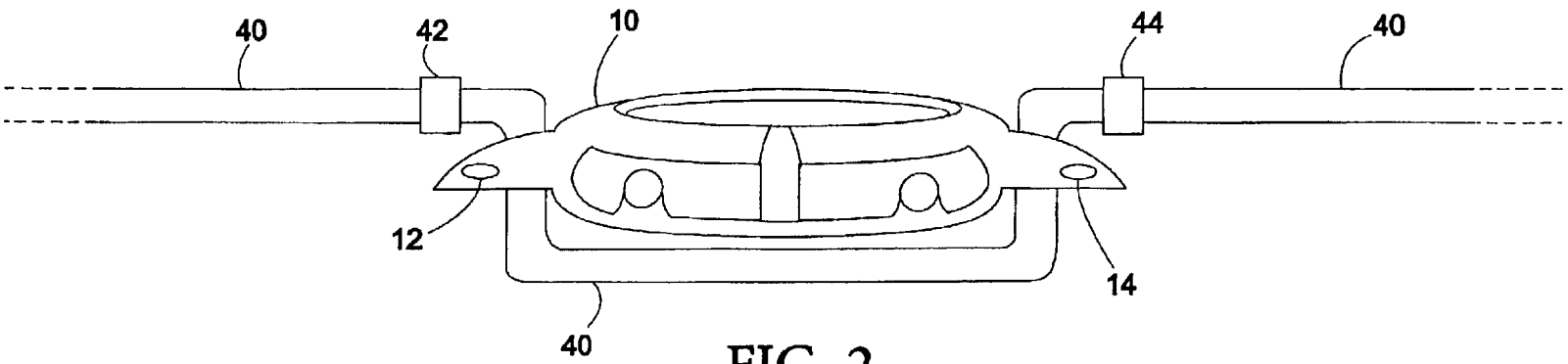
FIG. 2 is an exaggerated pictorial diagram of a watchcasing and a one-piece watchband attached thereto and held in place with security devices, in accordance with a second embodiment of the present invention.

Referring now to FIG. 2, there is shown a second embodiment of the present invention in which a one-piece watchband 40 is threaded behind watchcasing pins 12, 14 and behind watchcasing 10. A pair of security devices 42, 44, provided on watchband 40 on either side of watchcasing 10 serve to hold watchband 40 in a desired position and prevent it from moving with respect to watchcasing 10. The free ends of watchband 40 may be terminated in any of a number of conventional fasteners, not illustrated, to secure watchband 40 and watchcasing 10 to the wearer's wrist.

Figure 3:
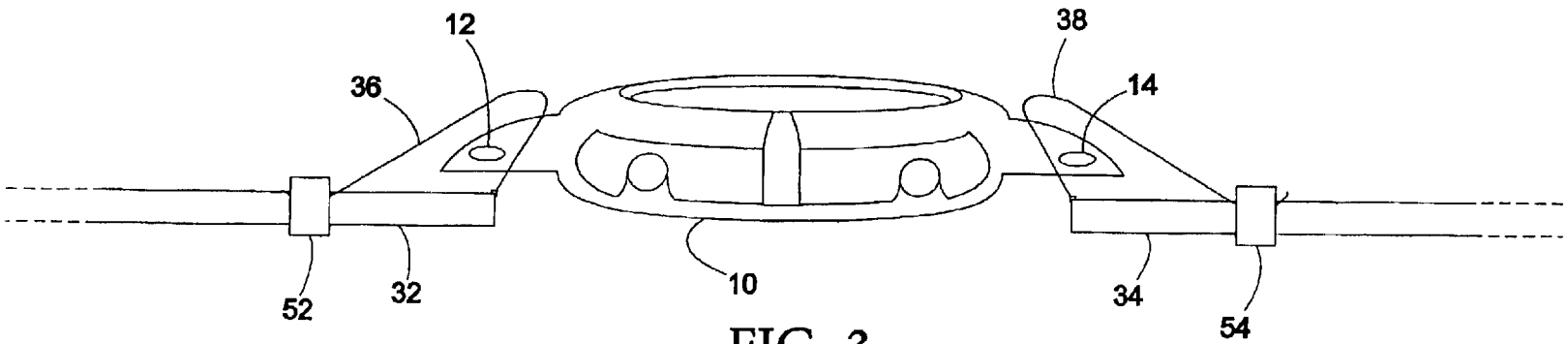
FIG. 3 is an exaggerated pictorial diagram of a watchcasing and a two-piece watchband attached thereto with clip members and security devices, in accordance with a third embodiment of the present invention.

Referring now to FIG. 3, there is shown a third embodiment of the present invention in which pieces 32, 34 of a two-piece watchband are provided with hinged clip members 36, 38, respectively, on ends thereof that are to be attached to watchcasing 10. Clip members 36, 38 are positioned behind watchcasing pins 12, 14, respectively, and then secured to watchband pieces 32, 34 by means of bands 52, 54 that are adapted to slide along watchband pieces 32, 34, respectively. The free ends of the watchband pieces 32, 34 may be terminated, like the two-piece watchband of FIG. 1 and the one-piece watchband of FIG. 1, in any one of a number of conventional fasteners to secure watchcasing 10 to the wearer's wrist.

I claim:

1. A quick-change two-piece watchband for attachment to a watchcasing, comprising:

a watchcasing having a first watchcasing pin at a first end thereof and having a second watchcasing pin at a second opposite end thereof;

a first piece of said two-piece watchband having a length of a hook and loop fastener material on a bottom surface thereof proximate an end thereof to be attached to said first end of said watchcasing, the hook and loop fastener material serving to secure said first piece in a desired position after said end of said first piece has been threaded behind said first watchcasing pin;

a second piece of said two-piece watchband having a length of a hook and loop fastener material on a bottom surface thereof proximate an end thereof to be attached to said second end of said watchcasing, the hook and loop fastener material serving to secure said second piece in a desired position after said end of said second piece has been threaded behind said second watchcasing pin; and a security device slideably positioned on each of said first and second pieces of said two-piece watchband proximate said watchcasing for providing added security to said hook and loop fastener material for holding each of said first and second pieces of said two-piece watchband in said desired position.

2. A method for attaching a two-piece watchband to a watchcasing, comprising:

providing a watchcasing having a first watchcasing pin at a first end thereof and having a second watchcasing pin at a second opposite end thereof;

providing a first piece of said two-piece watchband having a length of a hook and loop fastener material on a bottom surface thereof proximate an end thereof to be attached to said first end of said watchcasing;

threading said end of said first piece to be attached to said first end of said watchcasing downward and behind said first watchcasing pin;

folding said end of said first piece against itself after being threaded behind said first watchcasing pin for engaging said hook and loop fastener material to thereby secure said first piece in a desired position;

providing a second piece of said two-piece watchband having a length of a hook and loop fastener material on a bottom surface thereof proximate an end thereof to be attached to said second end of said watchcasing;

threading said end of said second piece to be attached to said second end of said watchcasing downward and behind said second watchcasing pin;

folding said end of said second piece against itself after it has been threaded behind said second watchcasing pin for engaging said hook and loop fastener material to thereby secure said second piece in a desired positions;

providing a security device on each of said first and second pieces of said two-piece watchband proximate said watchcasing; and sliding said security devices over said first and second pieces, respectively, after they have been folded against each other, to additionally secure said first and second pieces in said desired positions.

* * * * *